US006119369A

United States Patent [19]

Rodewald

[11] Patent Number: 6,119,369

[45] Date of Patent: Sep. 19, 2000

[54] VACUUM PREHEATER FOR WEB HEATING AND DRYING

[75] Inventor: Dennis W. Rodewald, Phillips, Wis.

[73] Assignee: Marquip, Inc., Phillips, Wis.

[21] Appl. No.: 09/338,462

[22] Filed: Jun. 22, 1999

[51] Int. Cl.[7] ..... F26B 9/00

[52] U.S. Cl. ..... 34/624; 34/633; 34/635

[58] Field of Search ..... 34/614, 618, 619, 34/623, 624, 629, 633, 634, 635, 636; 226/95, 97, 170; 156/137, 156, 159, 218, 285, 288, 502; 162/109, 117, 204, 205

[56] References Cited

U.S. PATENT DOCUMENTS

| | | | |
|---|---|---|---|
| 5,316,622 | 5/1994 | Babinsky et al. | 162/109 |
| 5,495,092 | 2/1996 | Marschke et al. | 219/388 |
| 5,600,900 | 2/1997 | Marschke | 34/519 |
| 5,706,994 | 1/1998 | Welch et al. | 226/95 |
| 5,857,605 | 1/1999 | Welch et al. | 226/95 |
| 5,906,698 | 5/1999 | House et al. | 156/137 |
| 5,926,973 | 7/1999 | Marschke | 34/634 |
| 5,996,246 | 12/1999 | Marschke | 34/634 X |

*Primary Examiner*—Stephen Gravini

*Attorney, Agent, or Firm*—Andrus, Sceales, Starke & Sawall, LLP

[57] ABSTRACT

A vacuum-assisted hot plate is used to precondition webs, such as paper webs used in the manufacture of corrugated paperboard. The vacuum-assisted preheater has a web supporting and heating surface separated into four sections, namely: an input section, a central upstream section, a central downstream section, and an output section. The sections are separated by three vacuum channels that are sized wide enough to prevent clogging from paper dust. The central upstream section and the central downstream section have convex surfaces. Vacuums applied to the vacuum channels provide a normal force to pull the traveling web against the heated surface, whereas the convex configuration of both the central upstream section and the central downstream section provide a normal force pushing on the paper web in the opposite direction. The result is effective positive contact of the traveling web against the heated surface, thereby promoting effective heat transfer. In addition, the vacuum tends to eliminate air pockets between the traveling web and the heated surface that can occur from time-to-time, which also facilitates effective heat transfer. Vacuum chambers provide vacuum to the vacuum channels, and are sized and configured to focus uniform vacuum forces effectively on the traveling web.

13 Claims, 3 Drawing Sheets

VACUUM PREHEATER FOR WEB HEATING AND DRYING

BACKGROUND OF THE INVENTION

The invention relates to the application of heat to a moving web of material and, in particular, to an apparatus and method for preheating a paper web to precondition prior to combination in a corrugated paperboard web.

In the manufacture of corrugated paperboard, the various component paper webs are usually preheated prior to the application of adhesive and the joining of one web to another. A common preheating device in a corrugator comprises a rotating steam heated roll around which the moving paper web is partially wrapped and heated before it is transferred to downstream processing equipment, such as a single facer or a double backer.

More recently, it has been found that web preheating devices may be substantially simplified and the heat transfer to the web provided more efficiently by utilizing a vacuum-assisted stationary hot plate over which the web travels. U.S. Pat. No. 5,600,900 entitled "Vacuum-Assisted Web Drying System" by Carl R. Marschke, issuing on Feb. 11, 1997 and assigned to the assignee of the present application as well as copending patent application entitled "Edged Seal for Vacuum Preheater" by Carl R. Marschke, filed on Jun. 1, 1998, Ser. No. 09/088,214 are examples of vacuum-assisted stationary hot plates for web drying. In practice, such hot plates have comprised a plurality of rectangular steam tubes that are arranged to form a generally planar web supporting surface with a plurality of narrow vacuum channels between the vacuum tubes. Although such vacuum hot plates are much simpler in construction than rotary preheating rolls, certain processing problems have arisen. For example, paper dust can clog the channels which reduces the effectiveness of the vacuum, thereby reducing heat transfer. In addition, it has been found that baggy lateral edges of the paper web often do not maintain sufficient surface contact with the heated surface to uniformly precondition the paper web.

SUMMARY OF THE INVENTION

The invention is a vacuum-assisted hot plate that has a web supporting and heating surface comprising four sections each separated by an open vacuum channel oriented perpendicular to the machine direction of the traveling web. The web supporting and heating surface has an upstream convex section and a downstream convex section. A vacuum channel is provided upstream of the upstream convex section, another channel is provided between the upstream convex section and the downstream convex section, and the third vacuum channel is provided downstream of the downstream convex section. As the web travels over the web supporting and heating surface, the vacuums provide normal force to pull the web against the web supporting and heating surface. The convex geometry provides normal force pushing against the web opposite to that of the vacuum, thereby effectively promoting positive contact of the web along the web supporting and heating surface. It has been found that this configuration is particularly effective in reducing air pockets between the web and the heating surface as well as promoting effective contact of the web against the heating surface, both of which promote uniform heat transfer.

The vacuum channels are preferably sufficiently wide (e.g. about ¼ of an inch) to prevent clogging by paper dust yet narrow enough to provide sufficient air velocity and pressure drop to hold the web against the web supporting and heating surface. In the preferred embodiment, the three vacuum channels extend transversely across essentially the entire width of the hot plate, and therefore extend outward beyond the width of the web. In accordance with another aspect of the invention, a separate vacuum chamber is provided for each channel. Preferably, the vacuum chamber has a baffle to facilitate equalization of vacuum distribution symmetrically on either side of the centerline of the hot plate. In addition, it is preferred that the transverse length of the vacuum chamber be less than the width of the typical paper web. With this configuration, the vacuum from the baffled vacuum chamber focuses its energy on pulling the web against the web supporting and heating surface without choking the vacuum or providing excessive drag on the web.

Another unique feature of the invention is that loose or baggy-edged paper webs tend to take a longer path over the convex sections of the web supporting and heating surface. This, in turn, provides more heat to the lateral edges of the paper edge, which tends to shrink the lateral edge and equalize heat and moisture content across the entire width of the web. As mentioned, equalizing heat and moisture content of the web is particularly desirable when manufacturing corrugated paperboard.

Other features and advantages of the invention may be apparent to those skilled in the art upon reviewing the following drawings and description thereof.

DETAILED DESCRIPTION OF THE INVENTION

Figure 1:
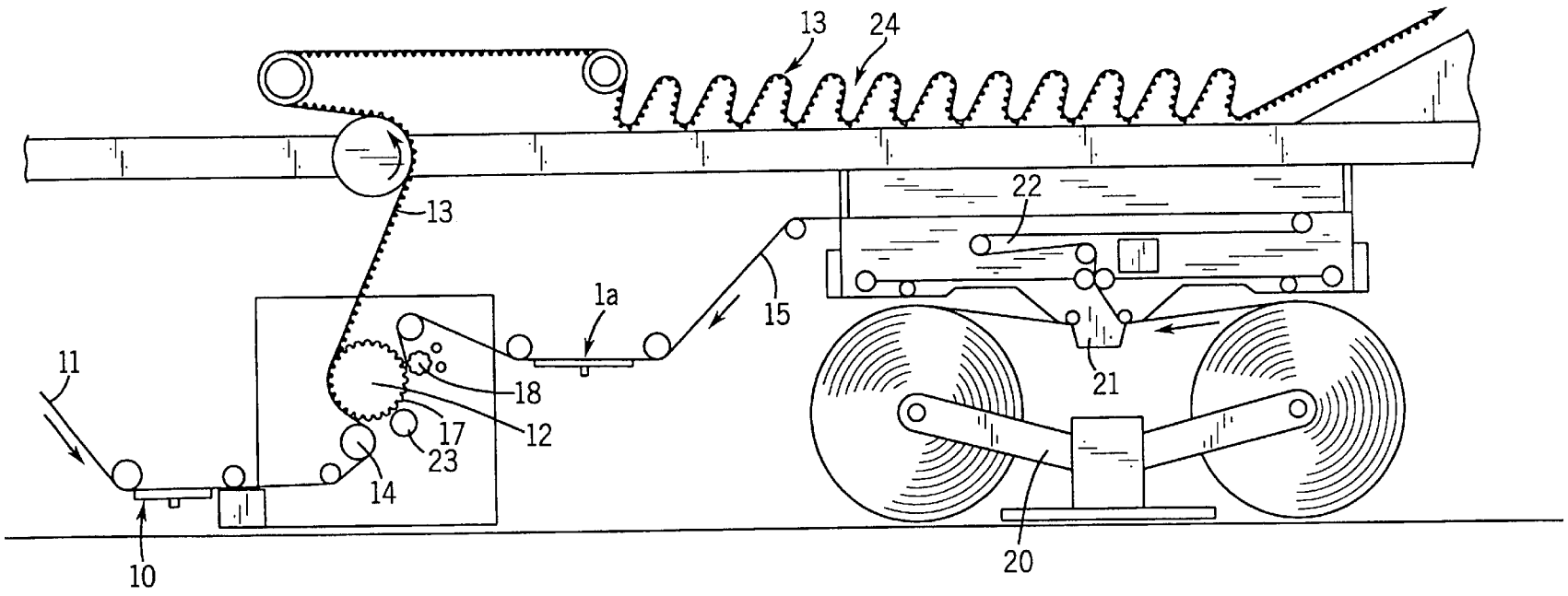
FIG. 1 is a schematic side elevation view of a corrugator single facer showing the use of vacuum-assisted preheaters in accordance with the invention.

In FIG. 1, a single facer, including two vacuum preheaters 10 configured in accordance with the invention, operates to adhesively joint a liner web 11 to a corrugated medium web 12 to form a composite single face web 13. The liner web 11 is typically delivered from a supply roll (not shown), through a splicer and into a web take-up mechanism, from which the web passes over the heated surface of the preheater 10 with webs heated to enhance the bond by which it is subsequently joined to the medium web. From the preheater 10, the liner web 11 passes around a liner application roll 14 (which may also be heated) where the liner web 11 is joined with the corrugated medium web 12. The corrugated medium web is formed from a plain web 15 drawn from a roll stand supply 20 from which it travels through a splicer 21 and take-up mechanism 22 onto another vacuum preheater 10 also configured in accordance with the invention. From the preheater 10, the web 15 passes between corrugating rolls 17 and 18 that provide the web with the characteristic corrugated or fluted configuration to form the corrugated medium web 12. One or both of the corrugating rolls 17 and 18 may also be heated. A glue applicator 23 is positioned to apply an adhesive such as an aqueous solution of a starch adhesive, to the tips of the flutes on one side of the corrugated medium web 12 as it passes around the larger corrugating roll 17. The glued corrugated medium web 12 and the liner web 11 are joined at the interface between the liner roll 14 and the large heated corrugating roll 17. The continuing wrap of the single face web 13 around the large diameter heated corrugating roll 17 cures the adhesive bond. The single face web 13 is then transferred onto a varying length storage device 24 for further processing.

Figure 2:
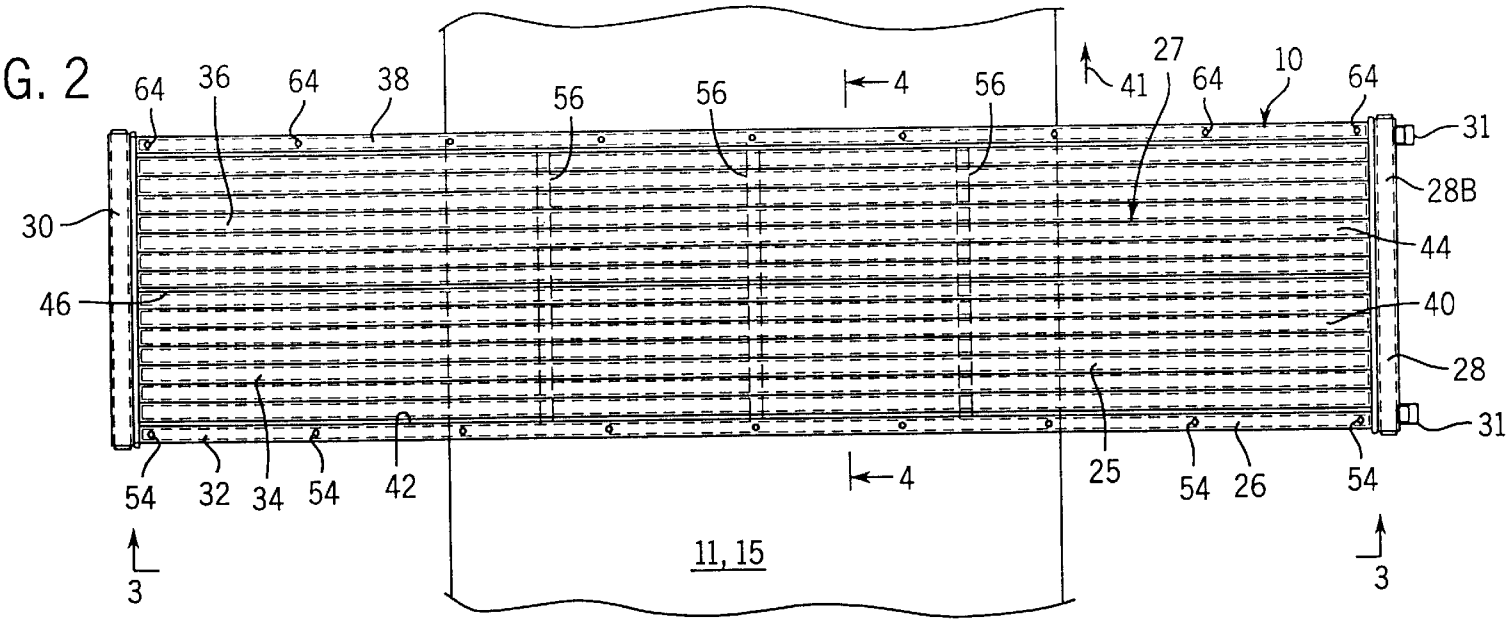
FIG. 2 is a top plan view of a preheater in accordance with the invention.
Figure 3:
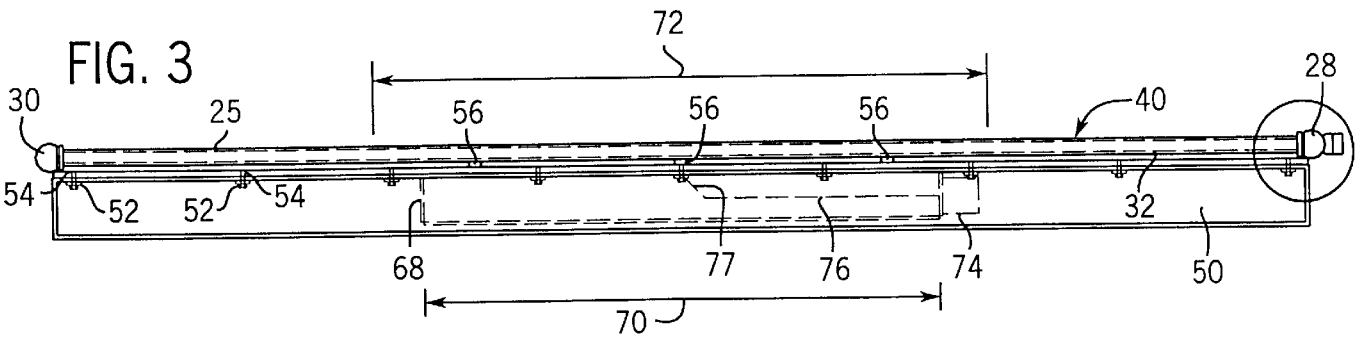
FIG. 3 is a side elevational view as viewed from the perspective of arrows 3 in FIG. 2.
Figure 4:
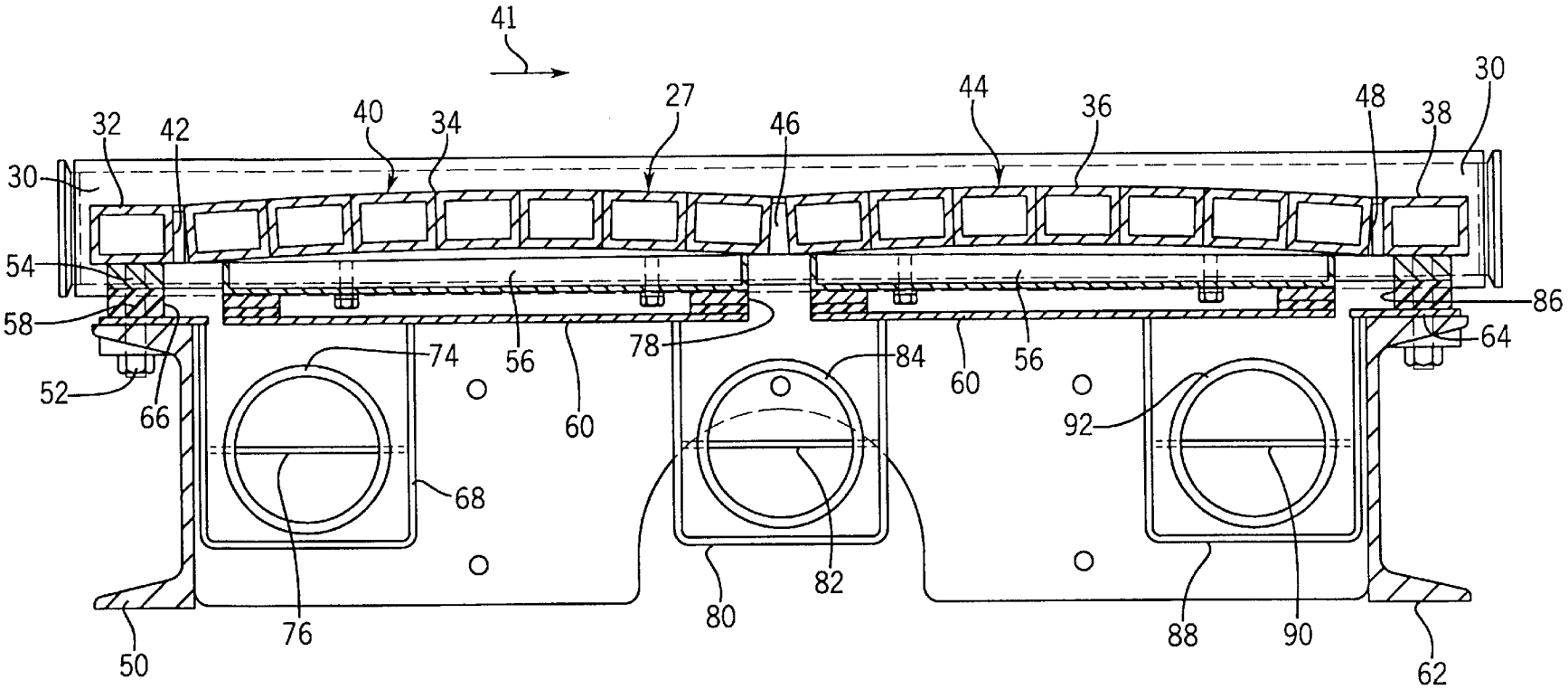
FIG. 4 is a cross-sectional view of a hot plate preheater in accordance with the invention as taken along lines 4—4 in FIG. 2.

Referring now to FIGS. 2–4, preheating of both the liner web 11 and the corrugated medium web 15 is important in attaining a good bond in the single face web 13. Also, uniform heating of the webs translates into uniform strength in the glue lines. Vacuum-assisted preheaters 10 configured in accordance with the invention preheat and precondition the webs in a particularly uniform and effective manner.

Each preheater 10 includes a vacuum hot plate 25 made from a series of parallel, generally rectangular tubes that are arranged to form a web supporting and heating surface 27. The generally rectangular tubes 26 are preferably thin wall steel tubes. The tubes 26 are open ended and connected together at respective opposite ends to a steam supply manifold 28, a steam distribution manifold 30 and a condensate collection manifold 28*b*. Steam is supplied to the steam manifold 28 through steam connection 31 and condensate is removed from the condensate manifold 28*b* via similar connections. The tubes 26 are nominally 1"×1½" thin wall rectangular steel tubes. Suitable tubes 26 have a maximum rate of pressure of approximately 250 psi. The pressure of the steam supplied to the tubes 26 can vary depending on the application, but a typical value would be approximately 175 psi (i.e. about 380° F.).

The steam tubes 26 forming the web supporting and heating surface 27 of the hot plate 25 are mounted to define four separate sections, namely an intake section 32, a central upstream section 34, a central downstream section 36, and an output section 38.

Referring now in particular to both FIGS. 2 and 4, the intake section 32 of the web supporting and heating surface 27 is preferably defined by a single rectangular tube. The central upstream section 34 is preferably formed by a plurality of tubes welded together. In the embodiment shown in the drawings, the central upstream section of the web supporting and heating surface 27 comprises seven generally rectangular tubes 34 that are arranged prior to welding to provide a convex surface 40. The intake section 32 and the central upstream section 34 are separated by open vacuum channel 42.

The central downstream section 36 of the web supporting and heating surface 27 is also preferably comprised of seven generally rectangular tubes arranged to form a convex surface 42. The central upstream section 34 and the central downstream section 36 are separated by a centrally located open vacuum channel 46. The output section 38 of the web supporting and heating surface 27 preferably consists of a single rectangular tube. The output section 38 is separated from the central downstream section 36 by open vacuum channel 48.

The rectangular tube comprising the intake section 32 is mounted to frame support channel 50 using nuts (such as nut 52 in FIG. 4) secured to threaded stems 54 that are connected to the tube 32 via a bar welded to the tube. A longitudinal support bar 56 and gaskets 58 as well as a piece of sheet metal 60 are secured between the intake section tube 32 and the channel 50. In a similar manner, the rectangular tube comprising the output section 38 is attached to frame support channel 62 via threaded stems 64 connected to tube 38 via a rectangular bar welded to the tube. There are three longitudinal support bars 56, see FIGS. 2 and 3. The set of seven generally rectangular tubes welded together to form the central upstream section 34 of the web supporting and heating surface 27 are welded to the longitudinal support bars 56, as are the set of seven tubes forming the central downstream section 36. In this mounting arrangement, the geometry of the web supporting and heating surface 27 remains relatively stable and warping is minimized even during thermal cycling. In addition, the surface 27 can be adjusted by adjusting the intake tube 32 and/or the output tube 38.

Referring in particular to FIGS. 3 and 4, a separate vacuum chamber and plenum is provided for each open vacuum channel 42, 46 and 48. For the intake vacuum channel 42, vacuum plenum 66 and rectangular vacuum chamber 68 are provided. The vacuum chamber 68 is attached to the underside of the hot plate 25 and the length of the vacuum chamber 68 as it extends transversely across the hot plate 25 is indicated by arrow 70 on FIG. 3. Arrow 72 on FIG. 3 depicts the minimum width of a paper web 11, 15 on which the hot plate 25 would typically be used. The width of conventional webs typically ranges between 48 inches to 96 inches. Note that the transverse length 70 of the vacuum chamber 68 is preferably less than the minimum width 72 of the web 11, 15. The vacuum chamber 68 preferably includes a circular input duct 74 to allow convenient attachment to circular vacuum conduit. A baffle 76 is preferably used to separate the vacuum chamber 68. The baffle 76 is preferably mounted horizontally along the input side of the vacuum chamber 68, towards the centerline of the hot plate, and angles upward (see reference numeral 77) to the centerline of the hot plate 25. The baffle 76 effectively facilitates equalization of vacuum distribution on either side of the centerline of the hot plate 25, even though the vacuum is provided from a single source.

While the vacuum chamber 68 extends transversely across the hot plate 25 for the length of arrow 70 which is less than the minimum width 72 of a paper web, the open vacuum channel 42 and the associated plenum 66 lying between the open channel 42 and the vacuum chamber 68 extend essentially the entire transverse width of the hot plate 25 between the manifolds 28 and 30. Because of this configuration, the force of the vacuum is focused on the web 11, 15, however, the outside portions of the channel 42 which are not covered by the web 11, 15 remain open to the atmosphere and prevent paper dust from clogging the vacuum channel.

A vacuum plenum 78, vacuum chamber 80 containing a baffle 82, and a circular input tube 84 are provided for the centrally-located open vacuum channel 46. Likewise, a vacuum plenum 86, a vacuum chamber 88 containing a baffle 90, and a circular input tube 92 are provided for open channel 48 at the output. The configurations of the centrally-located vacuum plenum 78 and vacuum chamber 80 as well as the vacuum plenum 86 and vacuum chamber 88 for the output are preferably similar and essentially identical in function as that described with respect to vacuum plenum 66 and vacuum chamber 68 for the vacuum channel 42 for the intake. In carrying out the invention, it is believed to be important to provide a reasonably constant vacuum, and it is also believed to be important to provide relatively high air velocity through the open vacuum channels. It has been found effective for the width of the open vacuum channels 42, 46, 48 along the web supporting and heating surface 27 to be approximately ¼ of an inch across the channel. If the vacuum channels 42, 46, 48 are significantly smaller than ¼ of an inch, the likelihood of clogging increases. Clogging of the vacuum channels 42, 46, 48 can substantially lessen the effectiveness of the hot plate, and therefore it is preferred that the width of the channels 42, 46, 48 remain about ¼ of an inch in width.

As shown in FIG. 2, a paper web 11, 15 is fed over the web supporting and heating surface 27 of the hot plate 25 in the direction of arrow 41. The application of vacuum holds the web 11, 15 in intimate contact with the web supporting and heating surface 27 and enhances heat transfer to the web. Although FIG. 4 does not depict a traveling web 11, 15 in order to simplify the drawing, the machine direction of the traveling web is also identified in FIG. 4 by arrow 41. As the web approaches from the left hand side of FIG. 4, the vacuum provided through intake vacuum channel 42 subjects the web to a downward normal force, thereby providing positive contact between the web and the web supporting and heating surface 27. Downstream, the web is likewise subjected to downward normal forces at the centrally-located vacuum channel 46 and at the output vacuum channel 48. The normal forces provided by the channels 42, 46 and 48 on either side of the central upstream section 34 and the central downstream section 36 provide positive contact along the convex surface 40 and 44, respectively. The heated convex surfaces 40, 44 provide normal forces pushing against the web, thus promoting full contact of the web along the respective convex surface 40, 44 and providing heat transfer. In addition, the vacuum flows provided through vacuum channels 42, 46, 48 eliminate air pockets on the traveling web, thereby eliminating any air gaps which could reduce heat transfer capabilities. As previously mentioned, loose or baggy edged paper webs tend to take a longer path over convex surfaces 40, 44 which in turn provide more heat to the lateral edges of the paper edge, tending to shrink the lateral edge and equalize heat and moisture content across the entire width of the web.

In some applications, it may be desirable to run a web in series over two or more preheaters as described herein. Also, it may be desirable to use a push bar to separate the web from the web supporting and heating surface when the machine shuts down, especially when more than one preheater is used in series.

It is recognized that other equivalents, alternatives and modifications aside from those expressly stated, are possible and within the scope of the following claims. For example, in the disclosed embodiment rectangular steam tubes are arranged to form the web supporting and heating surface and steam in the steam supply plumbing is the means for heating the web supporting and heating surface, however, other configurations such as electric heating may be possible.

I claim:

1. A vacuum-assisted hot plate for preheating and drying a traveling web comprising:

a stationary web supporting and heating surface having high thermal conductivity, the web supporting and heating surface comprising at least an upstream section and a downstream section wherein a web traveling longitudinally in a machine direction travels over the upstream section of the web supporting and heating surface before it travels over the downstream section of the web supporting and heating surface, a transverse cross-section of the upstream section of the web supporting and heating surface taken perpendicular to the machine direction being convex at least in part, and a transverse cross-section of the downstream section of the web supporting and heating surface taken perpendicular to the machine direction also being convex at least in part;

the upstream section and the downstream section of the web supporting and heating surface being separated by an open vacuum channel, wherein the upstream section is arranged such that a middle portion of the upstream section is located outward towards the path of the web farther than a portion of the upstream section adjacent the open vacuum channel, and the downstream section is arranged such that a middle portion of the downstream section is located outward towards the path of the web farther than a portion of the downstream section adjacent the open vacuum channel;

means for heating the web supporting and heating surface; and a vacuum chamber attached to the underside of the hot plate and communicating with the open vacuum channel located between the upstream section and the downstream section of the web supporting and heating surface;

wherein the traveling web is drawn towards the open vacuum channel and against the web supporting and heating surface when a vacuum is applied to the vacuum chamber and the web is traveling over the web supporting and heating surface.

2. An apparatus as recited in claim 1 wherein:

the upstream section of the stationary web supporting and heating surface is a central upstream section and the downstream section is a central downstream section;

the stationary web supporting and heating surface further comprises an intake section and an output section wherein the web travels over the intake section of the web supporting and heating surface before it travels over the central upstream section of the web supporting and heating surface and the web travels over the central downstream section of the web supporting and heating surface before it travels over the output section of the web supporting and heating surface;

the intake section and the central upstream section being separated by an intake open vacuum channel wherein the central upstream section of the web supporting and heating surface is arranged such that the middle portion of the central upstream section is located outwards towards the path of the web farther than a portion of the central upstream section adjacent the intake open vacuum channel; and the central downstream section and the output section being separated by an output open vacuum channel, wherein the central downstream section of the web supporting and heating surface is arranged such that the middle portion of the central downstream section is located outwards towards the path of the web farther than a portion of the central downstream section adjacent the output open vacuum channel.

3. An apparatus as recited in claim 2 wherein the recited vacuum chamber is a central vacuum chamber and the apparatus further comprises:

an intake vacuum chamber attached to the underside of the hot plate and communicating with the intake open vacuum channel; and an output vacuum chamber attached to the underside of the hot plate and communicating with the output open vacuum channel.

4. An apparatus as recited in claim 1 further comprising:

an elongated plenum extending transversely across the hot plate essentially the entire length of the open vacuum channel, the elongated plenum facilitating vacuum communication between the open vacuum channel and the vacuum chamber; wherein the open vacuum channel extends transversely across the hot plate for a distance greater than the width of webs run on the apparatus; and the vacuum chamber extends transversely across the hotplate for a distance less than the width of webs run on the apparatus.

5. An apparatus as recited in claim 4 wherein the vacuum chamber contains a baffle therein to facilitate equalization of vacuum distribution along the open vacuum channel.

6. An apparatus as recited in claim 1 wherein the means for heating the web supporting and heating surface heats the web supporting surface to a generally uniform temperature.

7. An apparatus as recited in claim 1 wherein:

a first set of steam tubes are arranged in parallel transversely across the hot plate and tightly against each other to form the upstream section of the web supporting and heating surface; and a second set of steam tubes are arranged in parallel transversely across the hot plate and tightly against each other to form the downstream section of the web supporting and heating surface.

8. An apparatus as recited in claim 7 wherein the tubes are generally rectangular tubes that are machined and arranged to provide the convex shape of the respective sections of the web supporting and heating surface.

9. An apparatus as recited in claim 7 wherein the means for heating the web supporting surface involves the flow of steam through the tubes.

10. An apparatus as recited in claim 2 wherein:

a first set of tubes are arranged in parallel transversely across the hot plate and tightly against each other to form the central upstream section of the web supporting and heating surface;

a second set of tubes are arranged in parallel transversely across the hot plate and tightly against each other to form the central downstream section of the web supporting and heating surface;

an intake tube is arranged transversely across the hot plate to form the intake section of the web supporting and heating surface; and an output tube is arranged across the hot plate to form the output section of the web supporting and heating surface.

11. An apparatus as recited in claim 10 wherein the means for heating the web supporting and heating surface involves the flow of superheated steam through the tubes.

12. A vacuum-assisted hot plate for preheating and drying a traveling web comprising:

a stationary web supporting and heating surface having high thermal conductivity, the web supporting and heating surface comprising an intake section, a central upstream section, a central downstream section, and an output section, wherein a web traveling longitudinally in a machine direction travels over the intake section before it travels over the central upstream section, and travels over the central upstream section before it travels over the central downstream section, and travels over the central downstream section before it travels over the output section;

the intake section and the upstream section being separated by an intake open vacuum channel, the intake open vacuum channel extending transversely across the hot plate for a distance greater than the width of webs run on the apparatus;

the central upstream section and the central downstream section being separated by a centrally located open vacuum channel, the centrally-located vacuum channel extending transversely across the hot plate for a distance greater than the width of webs run on the apparatus;

the central downstream section and the output section being separated by an output open vacuum channel, the output vacuum channel extending transversely across the hot plate for a distance greater than the width of webs run on the apparatus;

an intake vacuum chamber attached to the underside of the hot plate and communicating with the intake open vacuum channel, the vacuum chamber extending across the hot plate for a distance less than the width of webs run on the apparatus, the intake vacuum chamber containing a baffle therein which facilitates equalization of vacuum distribution along the intake open vacuum channel;

an central vacuum chamber attached to the underside of the hot plate and communicating with the centrally-located open vacuum channel, the central vacuum chamber extending across the hot plate for a distance less than the width of webs run on the apparatus, the central vacuum chamber containing a baffle therein to facilitate equalization of vacuum distribution along the central open vacuum channel; and an output vacuum chamber attached to the underside of the hot plate and communicating with the output open vacuum channel, the output vacuum chamber extending across the hot plate for a distance less than the width of webs run on the apparatus, the vacuum chamber containing a baffle therein to facilitate equalization of vacuum distribution along the output open vacuum channel.

13. An apparatus as recited in claim 12 wherein:

a first set of steam tubes are arranged in parallel transversely across the hot plate and tightly against each other to form the central upstream section of the web supporting and heating surface;

a second set of steam tubes are arranged in parallel transversely across the hot plate and tightly against each other to form the central downstream section of the web supporting and heating surface;

an intake steam tube is arranged in parallel across the hot plate to form the intake section of the web supporting and heating surface; and an output steam tube is arranged in parallel transversely across the hot plate to form the output central section of the web supporting and heating surface.

* * * * *